US005327519A

United States Patent [19]

Haggvist et al.

[11] Patent Number: 5,327,519

[45] Date of Patent: Jul. 5, 1994

[54] PULSE PATTERN EXCITED LINEAR PREDICTION VOICE CODER

[75] Inventors: Jari Haggvist, Oulu; Kari Jarvinen, Tampere; Kari-Pekka Estola, Oulu; Jukka Ranta, Salo, all of Finland

[73] Assignee: Nokia Mobile Phones Ltd., Salo, Finland

[21] Appl. No.: 885,651

[22] Filed: May 19, 1992

[30] Foreign Application Priority Data

May 20, 1991 [FI] Finland ..... 912438

[51] Int. Cl.[5] ..... G10L 9/00

[52] U.S. Cl. ..... 395/2.28

[58] Field of Search ..... 381/29-51; 395/2, 28

[56] References Cited

U.S. PATENT DOCUMENTS

| | | | |
|---|---|---|---|
| 4,701,954 | 10/1987 | Atal | 381/49 |
| 4,817,157 | 3/1989 | Gerson | 381/40 |
| 4,932,061 | 6/1990 | Kroon et al. | 381/30 |

FOREIGN PATENT DOCUMENTS

| | | |
|---|---|---|
| 0296764 | 12/1988 | European Pat. Off. . |
| 0307122 | 3/1989 | European Pat. Off. . |
| 0361432 | 9/1989 | European Pat. Off. . |
| 0405548 | 6/1990 | European Pat. Off. . |
| 0415163 | 8/1990 | European Pat. Off. . |
| 0462559 | 12/1991 | European Pat. Off. . |
| 892049 | 4/1989 | Finland . |
| 903990 | 8/1990 | Finland . |

*Primary Examiner*—Michael R. Fleming
*Assistant Examiner*—Michelle Doerrler
*Attorney, Agent, or Firm*—Perman & Green

[57] ABSTRACT

Speech coding of the code excited linear predictive type is implemented by providing an excitation vector which comprises a set of a pre-determined number of pulse patterns from a codebook of P pulse patterns, which have a selected orientation and a pre-determined delay with respect to the starting point of the excitation vector. This requires modest computational power and a small memory space, which allows it to be implemented in one signal processor.

7 Claims, 5 Drawing Sheets

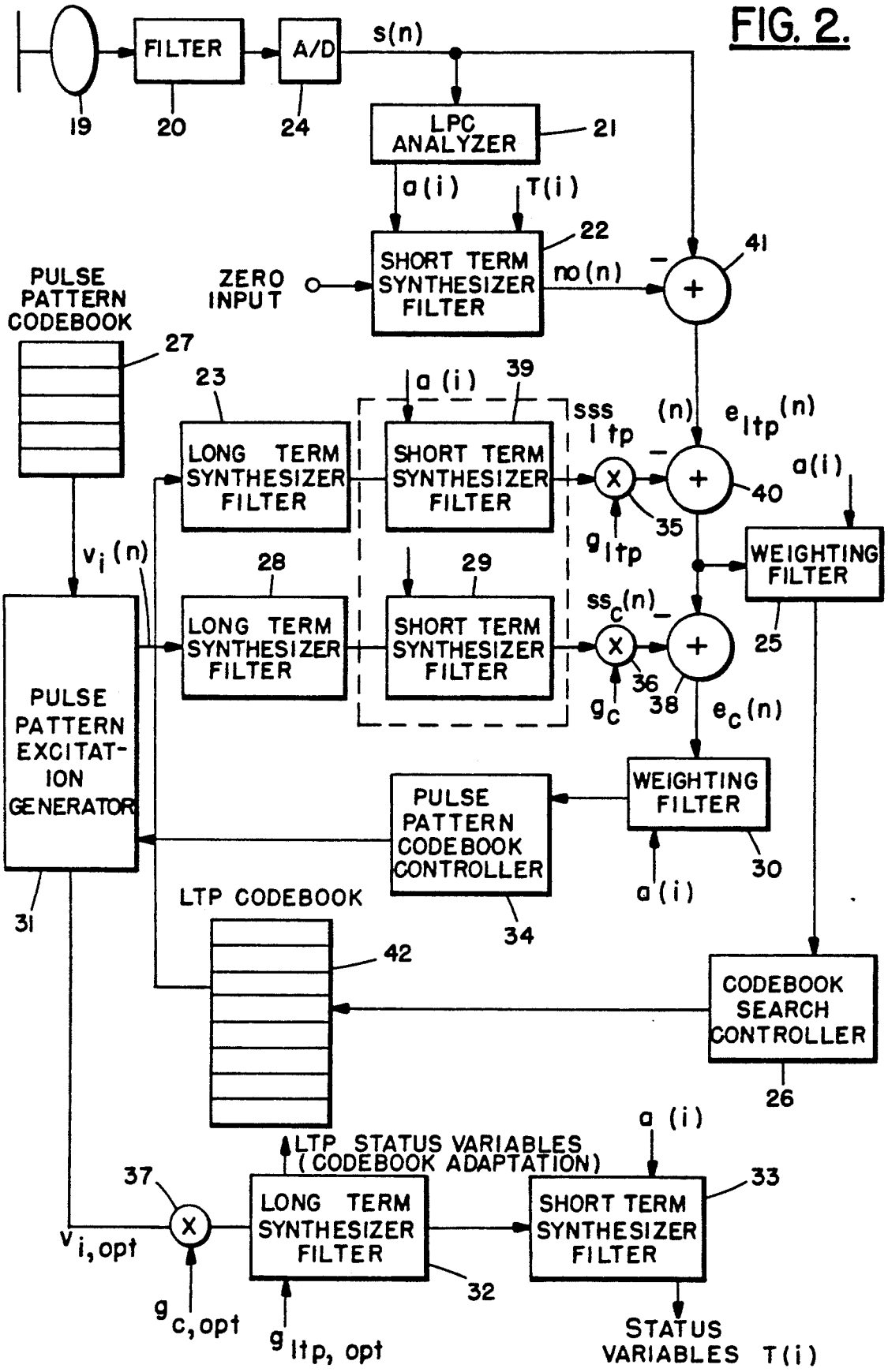
FIG. 2.
FILTER
A/D
s(n)
19
20
24
LPC ANALYZER
21
a(i)
T(i)
22
SHORT TERM SYNTHESIZER FILTER
ZERO INPUT
no(n)
41
PULSE PATTERN CODEBOOK
27
23
a(i)
39
LONG TERM SYNTHESIZER FILTER
SHORT TERM SYNTHESIZER FILTER
sss ltp (n)
e ltp (n)
40
35
g ltp
a(i)
WEIGHTING FILTER
25
v i (n)
28
29
LONG TERM SYNTHESIZER FILTER
SHORT TERM SYNTHESIZER FILTER
ss c (n)
36
38
g c
e c (n)
PULSE PATTERN EXCITATION GENERATOR
31
PULSE PATTERN CODEBOOK CONTROLLER
34
WEIGHTING FILTER
30
a(i)
LTP CODEBOOK
42
CODEBOOK SEARCH CONTROLLER
26
a (i)
LTP STATUS VARIABLES (CODEBOOK ADAPTATION)
37
33
v i, opt
LONG TERM SYNTHESIZER FILTER
SHORT TERM SYNTHESIZER FILTER
32
g c, opt
g ltp, opt
STATUS VARIABLES T(i)

PULSE PATTERN EXCITED LINEAR PREDICTION VOICE CODER

FIELD OF THE INVENTION

The invention relates to speech coding particularly to code excited linear predictive coding of speech.

BACKGROUND OF THE INVENTION

Efficient speech coding procedures are continually developed. In the prior art, Code Excited Linear Prediction (CELP) coding is known, which is explained in detail in the article by M. R. Schroeder and B. S. Atal: 'Code-Excited Linear Prediction (CELP): High Quality Speech at Very Low Bit Rates', Proceedings of the IEEE International Conference of Acoustics, Speech and Signal Processing ICASSP, Vol. 3, pp 937–940, March 1985.

Coding according to an algorithm of the CELP-type could be considered an efficient procedure in the prior art, but a disadvantage is the high computational power it will require. A CELP coder comprises a plurality of filters modeling speech generation, for which a suitable excitation signal is selected from a codebook containing a set of excitation vectors. The CELP coder usually comprises both short and long term filters where a synthesized version of the original speech signal is generated. In a CELP coder for an exhaustive search each individual excitation vector stored in the codebook for each speech block is applied to the synthesizer comprising the long and short term filters. The synthesized speech signal is compared with the original speech signal in order to generate an error signal. The error signal is then applied to a weighting filter forming the error signal according to the perceptive response of human hearing, resulting in a measure for the coding error which better corresponds to the auditory perception. An optimal excitation vector for the respective speech block to be processed is obtained by selecting from the codebook that excitation vector which produces the smallest weighted error signal for the speech block in question.

For example, if the sampling rate is 8 kHz, a block having the length of 5 milliseconds would consist of 40 samples. When the desired transmission rate for the excitation is 0.25 bits per sample, a random code book of 1024 random vectors is required. An exhaustive search for all these vectors results in approximately 120,000,000 multiply and Accumulate (MAC) operations per second. Such a computation volume is clearly an unrealistic task for today's signal processing technology. In addition, the memory consumption is unpractical since a Read Only Memory of 640 kilobit would be needed to store the codebook of 1024 vectors (1024 vectors; 40 samples per vector; each sample represented by a 16-bit word).

The above computational problem is well known, and in order to simplify the computation different proposals have been presented, with which the computational load and the memory consumption can be substantially reduced so that it would be possible to realize the CELP algorithm with signal processors in real time. Two different approaches may be mentioned here:

1) implementing the search procedure in a transform domain using e.g. a discreet Fourier transform; see I. M. Trancoso, B. S. Atal: 'Efficient Procedures for Finding the Optimum Innovation in Stochastic Coders'. Proc ICASSP, Vol. 4, p. 2375–2378, April 1986;

2) the use of vector sum techniques; I. A. Gershon, M. A. Jasiuk: 'Vector Sum Excited Linear Prediction Speech Coding at 8 kbit/s', Proc. ICASSP, p. 461–464, 1990.

SUMMARY OF THE INVENTION

The object of the present invention is to provide a coding procedure of the CELP type and a device realizing the method, which is better suited to practical applications than known methods. Particularly the invention is aimed at developing an easily operated codebook and at developing a searching or lookup procedure producing a calculating function which requires less computation power and less memory, at the same time retaining a good speech quality. This should result in an efficient speech coding, with which high quality speech can be transmitted at transmission rates below 10 kbit/s, and which imposes modest requirements on computational load and memory consumption, whereby it is easily implemented with today's signal processors.

According to the present invention, there is provided a method for synthesizing a block of original speech signal in a speech coder, the method comprising the step of applying an optimal excitation vector to a first synthesizer branch of the coder, to produce a block of synthesized digital speech, characterized in that the optimal excitation vector comprises a first set of a predetermined number of pulse patterns selected from a codebook of the coder, the codebook comprising a second set of pulse patterns, the selected pulse patterns having a selected orientation and a predetermined delay with respect to the starting point of the excitation vector. This has the advantage that instead of evaluating all excitations, the synthesizer filters process only a limited number (P) of pulse patterns, but not the set of all excitation vectors formed by them, whereby the computational power to search the optimal excitation vector is kept low. The invention also achieves the advantage that only a limited number (P) of pulse patterns needs to be stored into memory, instead of all excitation vectors.

According to the invention there is also provided a speech coder for processing a synthesized speech signal from a received digital speech signal comprising a first synthesizer branch operable to produce a block of synthesized speech from an applied excitation vector and means to generate the excitation vector in the form of a set of a pre-determined number of pulse patterns selected from a codebook coupled to the generating means, the pulse patterns having a selected orientation and delay with respect to the starting point of the excitation vector. This has the advantage that in a CELP coder, for an exhaustive search, all sealed excitation vectors would have to be processed whereas in the coder according to the invention only a small number of pulse patterns are filtered.

The pulse pattern excited linear prediction (PPELP) according to the invention permits an easy real time implementation of CELP-type coders by using signal processors. In the case mentioned above (1024 excitation vectors), a PPELP coder according to the invention requires less than 2,000,000 MAC operations per second for the whole search process, so it is easily implemented with one signal processor. As only pulse patterns are stored instead of all excitation vectors, it can be said that the need for a codebook is substantially eliminated. Thus a real time operation is achieved with a moderate power consumption.

BRIEF DESCRIPTION OF THE DRAWING

The invention will now be described, by way of example only, with reference to the accompanying drawings of which:

FIG. 2 is a basic block diagram of an encoder illustrating how PPELP is implemented;

DETAILED DESCRIPTION OF THE INVENTION

We call the method according to the invention a pulse pattern method, i.e. Pulse Pattern Excited Linear Prediction (PPELP) Coding which, in a simplified way, may be described as an efficient excitation signal generating procedure and as a procedure for searching for optimal excitation, developed for a speech coder, where the excitation is generated based on the use of pulse patterns suitably delayed and oriented in relation to the starting point of the excitation vector. The codebook of a coder using this PPELP coding which contains the excitation vectors can be handled effectively when each excitation vector is formed as a combination of pulse patterns suitably delayed in relation to the starting point of the excitation vector. From the codebook containing a limited number (P) of pulse patterns the coder selects a predetermined number (K) of pulse patterns, which are combined to form an excitation vector containing a predetermined number (L) of samples.

Figure 1A:
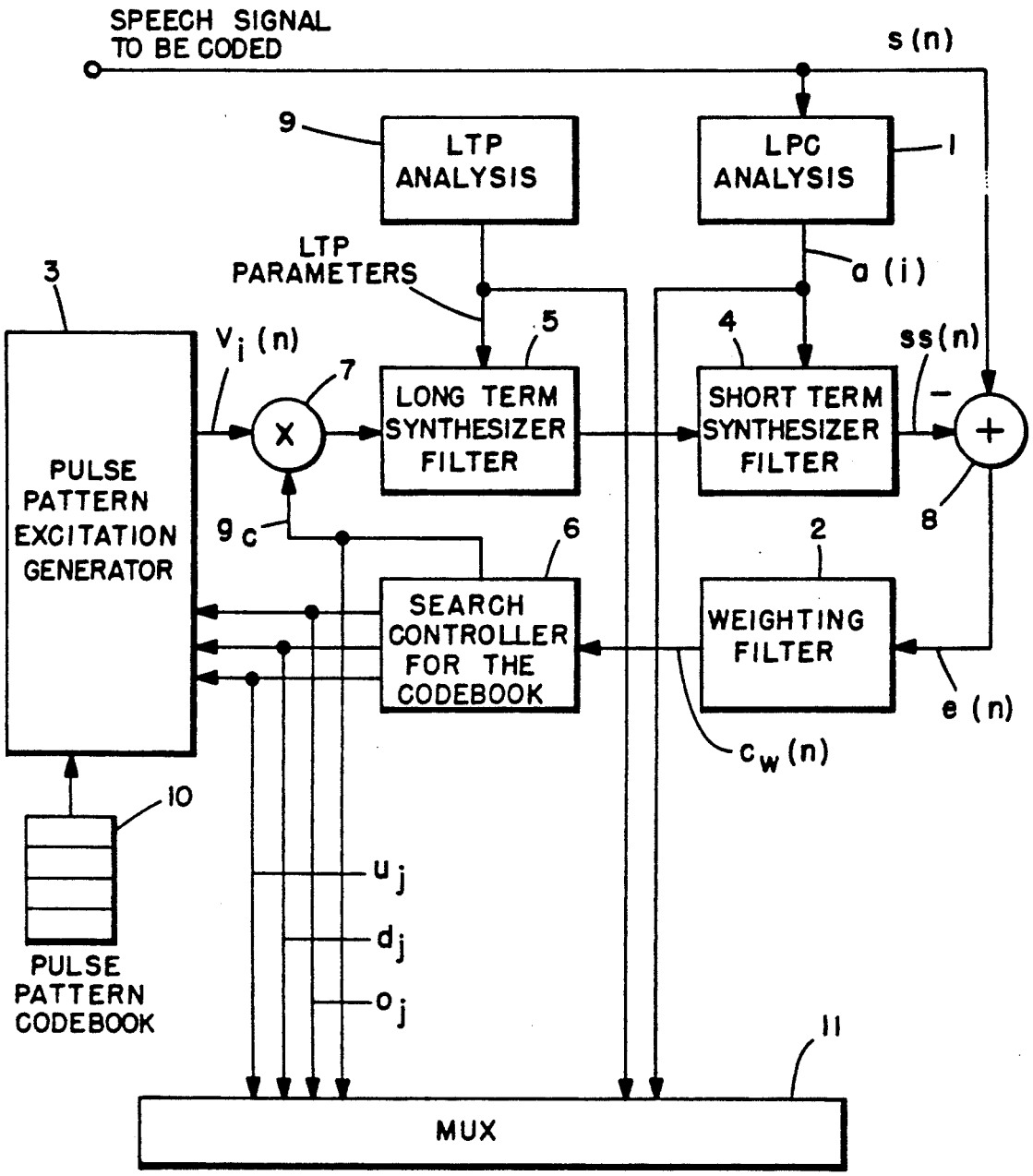
FIG. 1*a* is a general block diagram of a CELP encoder illustrating implementation of PPELP.

In order to illustrate the PPELP coding according to the invention FIG. 1*a* shows a block diagram of a CELP-type coder, in which the PPELP method is implemented. Here the coder comprises a short term analyzer 1 to form a set of linear prediction parameters a(i), where i=1, 2, . . . , m and where m=the order of the analysis. The parameter set a(i) describes the spectral content of the speech signal and is calculated for each speech block with N samples (the length of N usually corresponds to an interval of 20 milliseconds) and are used by a short term synthesizer filter 4 in the generation of a synthesized speech signal ss(n). The coder comprises, besides the short term synthesizer filter 4, also a long term synthesizer filter 5. The long term filter 5 is for the introduction of voice periodicity (pitch) and the short term filter 4 for the spectral envelope (formants). Thus, the two filters are used to model the speech signal. The short-term synthesizer filter 4 models the operation of the human vocal tract while the long-term synthesizer filter 5 models the oscillation of the vocal chords. The Long Term Prediction (LTP) parameters for the long term synthesizer filter are calculated in a Long Term Prediction (LTP) analyzer 9.

A weighting filter 2, based on the characteristics of the human hearing sense, is used to attenuate frequencies at which the error e(n), that is the difference between the original speech signal s(n) and the synthesized speech signal ss(n) formed by the subtracting means 8, is less important according to the auditory perception, and to amplify frequencies where the error according to the auditory perception is more important. The excitation for each excitation block of L samples is formed in an excitation generator 3 by combining together pulse patterns suitably delayed in relation to the beginning of the excitation vector. The pulse patterns are stored in a codebook 10. In an exhaustive search in a CELP coder all scaled excitation vectors $v_i(n)$ would have to be processed in the short term and long term synthesizer filters 4 and 5, respectively, whereas in the PPELP coder the filters process only pulse patterns.

A codebook search controller 6 is used to form control parameters $u_j$ (position of the pulse pattern in the pulse pattern codebook), $d_j$ (position of the pulse pattern in the excitation vector, i.e. the delay of the pulse pattern with respect to the starting point of the block), $o_j$ (orientation of the pulse pattern) controlling the excitation generator 3 on the basis of the weighted error $e_w(n)$ output from the weighting filter 2. During an evaluation process optimum pulse pattern codes are selected i.e. those codes which lead to a minimum weighted error $e_w(n)$.

A scaling factor $g_c$, the optimization of which is described in more detail below in connection with the search of pulse pattern parameters, is supplied from the codebook search controller 6 to a multiplying means 7 to which are also applied the output from the excitation generator 3. The output from the multiplier 7 is input to the long term synthesizer 5. The coder parameters a(i), LTP parameters, $u_j$, $d_j$ and $o_j$ are multiplexed in the block 11 as is $g_c$. It must be noted, that all parameters used also in the encoding section of the coder are quantized before they are used in the synthesizer filters 4, 5.

Figure 1B:
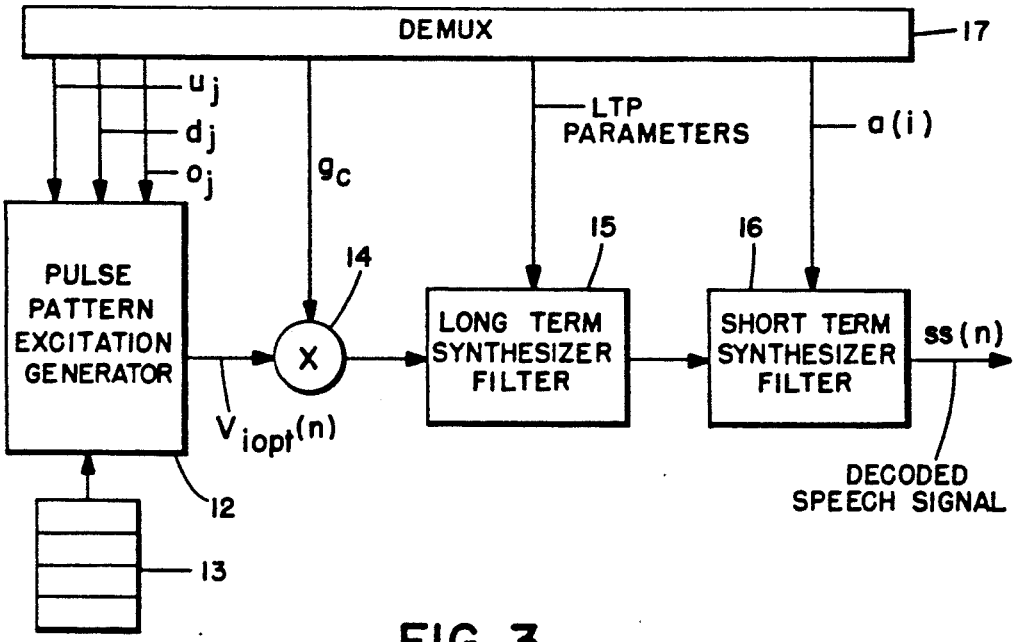
FIG. 1*b* shows a corresponding decoder.

The decoder functions are shown in FIG. 1*b*. During decoding the demultiplexer 17 provides the quantized coding parameter i.e. $u_j$, $d_j$, $o_j$, scaling factor $g_c$, LTP parameters and a(i). The pulse pattern codebook 13 and the pulse pattern excitation generator 12 are used to form the pulse pattern excitation signal $V_{i,opt}(n)$ which is scaled in the multiplier 14 using scaling factor $g_c$ and supplied to the long term synthesizer filter 15 and to the short term synthesizer filter 16, which as an output provides the decoded speech signal ss(n).

A basic block diagram of an encoder is shown in FIG. 2 illustrating in a general manner the implementation of PPELP encoding. The speech signal to be encoded is applied to a microphone 19 and thence to a filter 20, typically of a bandpass type. The bandpass filtered analog signal is then converted into a digital signal sequence using an analog to digital (A/D) converter 24. Eight kHz is used as the sampling frequency in this embodiment example. The output signal s(n) which is a digital representation of the original speech signal is then forwarded to a multiplying means 41 and into an LPC analyzer 21, where for each speech block of N samples a set of LPC parameters (in our example N=160) is produced using a known procedure. The resulting short term predictive (STP) parameters a(i), where i=1, 2, . . . , m (in our example m=10), are applied to a multiplexer and sent to the transmission channel for transmission from the encoder. Methods for generating LPC parameters are discussed e.g. in the article B.S.Atal: 'Predictive Coding of Speech at Low Bit Rates', IEEE Trans. Comm., Vol COM-30, pp.

600–614, April 1982. These parameters are used in the synthesizing procedure both in the encoder as well as in the decoder.

The STP parameters a(i) are used by short term filters 22, 39, 29 and weighting filters 25, 30 as discussed below.

The transmission function of a short term synthesizer filter has the transfer function 1/A(z), where $$A(z) = 1 - \sum_{i=1}^{m} a(i)\, z^{-i} \tag{1}$$

In the PPELP coder, pulse patterns stored in a pulse pattern codebook 27 are processed in a long term synthesizer filter 28 and in the short term synthesizer filter 29 to get responses for the pulse pattern. The output from the short term synthesizer filter 29 is scaled using scaling factor $g_c$ input to multiplier 36 and which is calculated in conjunction with the optimal excitation vector search. The resultant synthesized speech signal $ss_c(n)$ is then input to subtracting means 38.

The coder also comprises a zero input prediction branch comprising a short term synthesizer filter 22. This zero input prediction branch is where the effect of status variables of the short-term predictor branch, i.e. that branch including filters 28, 29, is subtracted from the speech signals s(n). This removes the effect of status variables from previously analyzed speech blocks. This technique is well known. The output $n_o(n)$ is supplied to the subtracting means 41 to which is also supplied the digital speech signal s(n). The resultant output is supplied to a further subtracting means 40.

Also supplied to the subtracting means 40 is the output from a long term prediction branch of the coder which includes a long term synthesizer filter 23, short term synthesizer filter 39 and multiplier 35.

The resultant output error $e_{ltp}(n)$ from the subtracting means 40, is supplied to subtracting means 38, and to a second weighting filter 25.

The synthesized speech signal $ss_c(n)$ and the digital speech signal s(n), modified with the aid of the zero input prediction branch, are thus compared using subtracting means 38, and the result is an output difference signal $e_c(n)$.

The difference signal $e_c(n)$ is filtered by the weighting filter 30 utilizing the STP parameters generated in the LPC analyzer 21. The transfer function of the weighting filter is given by:

$$w(z) = \frac{1 - \sum_{i=1}^{m} a(i)\, z^{-i}}{1 - \sum_{i=1}^{m} a(i)\, y\, z^{-i}} \tag{2}$$

The weighting factor y typically has a value slightly less than 1.0. In our embodiment example, y is chosen as y=0.83. The search procedure is controlled by the excitation codebook controller 34. The pulse pattern parameters ($u_j$, $d_j$, $o_j$) of the excitation vector $v_i(n)$ containing L samples—in our embodiment, L=40—that give the minimum error are searched using a pulse pattern codebook controller 34 of the pulse pattern codebook 10 and transmitted, over the channel, via the multiplexer, as the optimal excitation parameters, to the decoder. The optimal scaling factor $g_{c,opt}$ used in the multiplying block 37 has also to be transmitted.

The coder also uses a one-tap long term synthesizer filter 28 having the transfer function of the form 1/P(z), where $$P(z) = 1 - bz^{-M} \tag{3}$$

The parameters b and M are Long Term Prediction (LTP) parameters and are estimated for each block of B samples (in our embodiment B=40) using an analysis-synthesis procedure otherwise known as closed loop LTP. The optimal LTP parameters are calculated in a similar way as the codebook search. The closed loop search for the LTP parameters may be construed as using an adaptive codebook, where the time-lag M specifies the position in the codebook of the excitation vector selected from the codebook 42, and b corresponds to the long-term scaling factor $g_{1tp}$ of the excitation vector. Also the long term scaling factor $g_{ltp}$ used in the multiplier 35 is calculated in conjunction with the optimal parameter search.

The LTP parameters could be calculated simultaneously with the actual pulse pattern excitation. However, this approach is complex. Therefore a two-step procedure described below is preferred in this embodiment example.

In the first step the LTP parameters are computed by minimizing the error $e_{ltp}(n)$ which has been weighted and in the second step the optimal excitation vector is searched by minimizing $e_c(n)$. To do this requires a second synthesizer branch hereinafter referred to as the long-term predictions branch containing a second set of short term and long term synthesizer filters 23 and 29, a subtracting means 40, a second weighting filter 25 and a codebook search controller 26. Here it should be noted, that the effect of the previous excitation vector or the zero input response no (n) from the synthesizer filter 22, has no effect in the search process, so that it can be subtracted from the input speech signal s(n) by the subtracting means 41 as discussed above.

Status variables i.e. for the LTP codebook 42 and those T(i) (where i=1, 2, . . . m) for the short term synthesizer filters, are up-dated by supplying the optimal pulse pattern excitation from the excitation generator 31, suitably amplified in the multiplier 37 using the scaling factor $g_{c,opt}$, to long term and the short term synthesizer filters 32 and 33.

The evaluation of the relatively modest LTP codebook is a task not as complicated as the evaluation of a usually considerably larger fixed codebook. Using recursive techniques and truncation of the impulse response the computational requirements on the closed loop optimization procedure can be kept reasonable when the LTP parameters are optimized. The following discussion concentrates on the search of the optimal excitation vector from the codebook containing the actual fixed excitation vectors.

Figure 4:
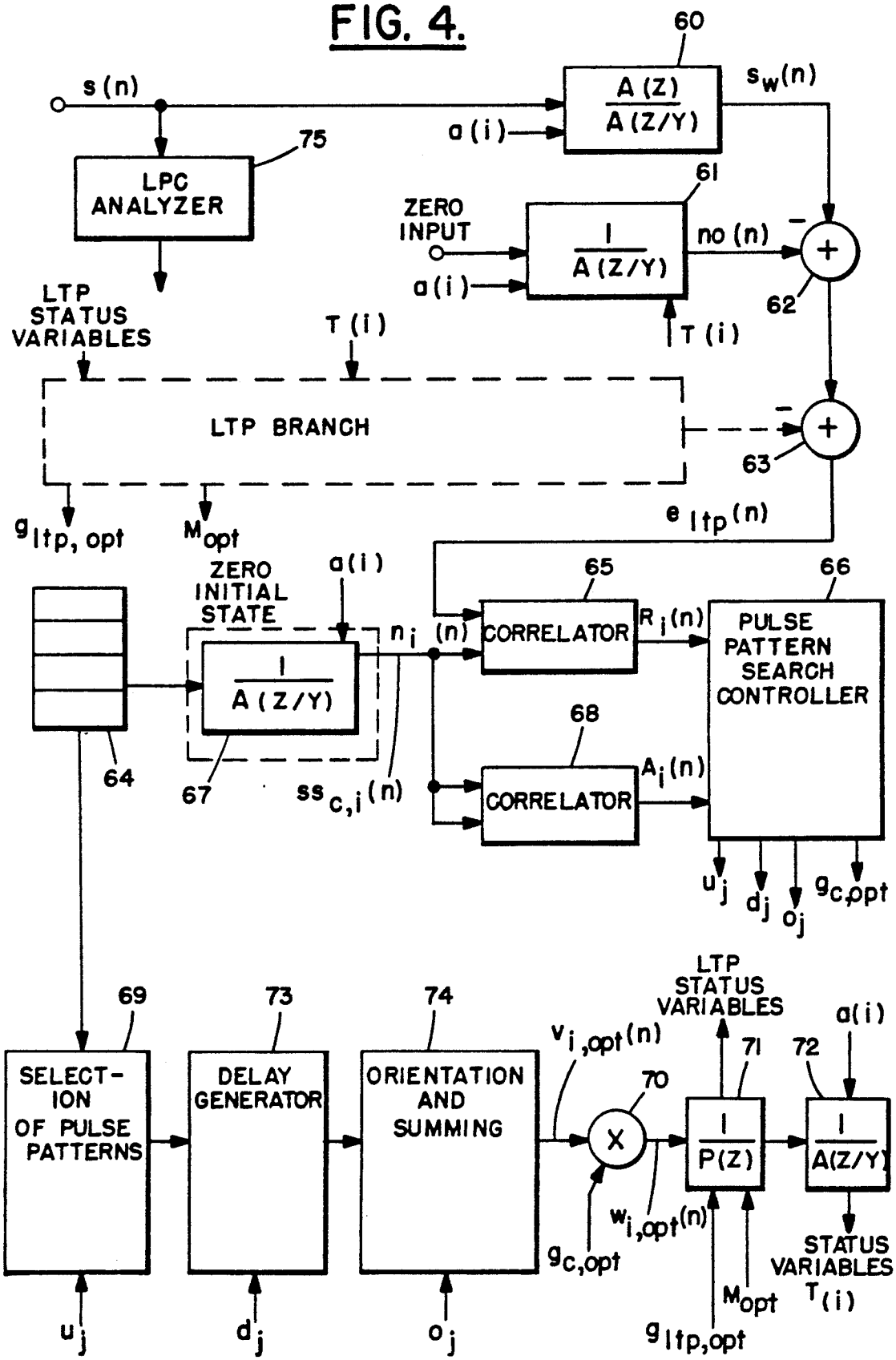
FIG. 4 is a detailed block diagram of a PPELP coder according to the invention.

It must be noted that FIG. 2 illustrates the encoder function in principle, and for the simplicity it does not contain a complete description of the excitation signal optimization method based on the pulse pattern technique described below. FIG. 4, which is described below, gives a more detailed description of how the pulse pattern technique is used.

Figure 3:
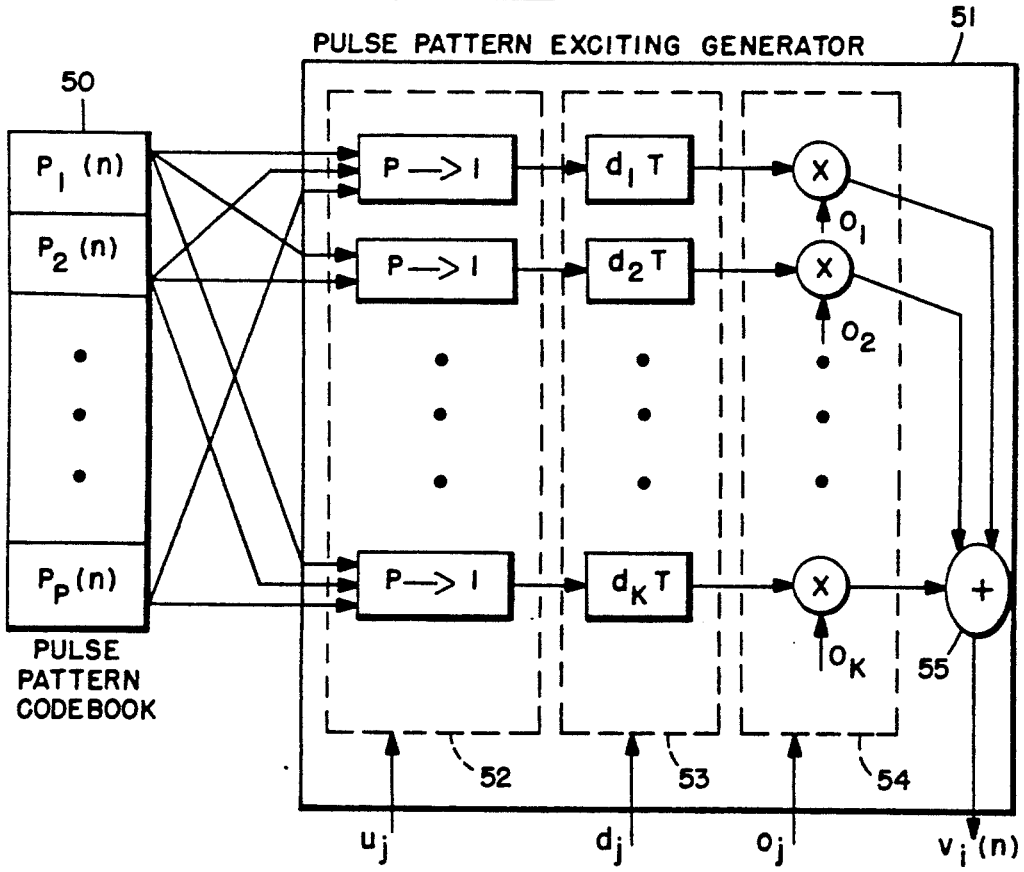
FIG. 3 illustrates the pulse pattern generator of an encoder according to the invention.

FIG. 3 shows the excitation generator 51 according to the invention, which corresponds to the generator 3 in FIG. 1*a* and the generator 12 of FIG. 1*b*. In a PPELP coder each excitation vector is formed by selecting a total of K pulse patterns from a codebook 50 containing a set of P pulse patterns $p_j(n)$, where $1 \leqq j \leqq P$. The pulse patterns selected by the pulse pattern selection block 52 are employed in the delay block 53 and the orientation block 54 to produce the excitation vectors $v_i(n)$ in the adder 55, where i is the consecutive number of the excitation vector.

A total of $(2P)^{K(L)}$ excitation vectors can be generated with the pulse pattern method in the excitation generator. Half of all the excitation vectors are opposite in sign compared to the other half, and thus it is not necessary to process them when the optimal excitation vector is searched by the synthesizer filters, but they are obtained when the scaling factor $g_c$ has negative values. The evaluated excitation vectors $v_i(n)$, where $i=1, 2, \ldots, (2P)^{K(L)}/2$ and $n=0, 1, 2 \ldots, L-1$, are of the form:

$$v_i(n) = \sum_{j=1}^{K} o_j p_{uj}(n - d_j) \tag{4}$$

where $u_j$ $(1 \leqq j \leqq K)$ defines the position of the j'th pulse pattern in the pulse pattern codebook $(1 \leqq u_j \leqq P)$, $d_j$ the position of the pulse pattern in the excitation vector $(0 \leqq d_j \leqq L-1)$, and $o_j$ its orientation (+1 or −1).

The excitation effect of the pulse patterns based on the pulse pattern technique can be evaluated by processing in the synthesizer filters only a predetermined number P of pulse patterns $(p_1(n), p_2(n), \ldots, p_P(n))$. Thus the evaluation of the excitation vectors can be performed very efficiently. A further advantage of the pulse pattern method is that only a small number of pulse patterns need to be stored, instead of the entire set of $(2P)^{K(L)}$ vectors. High quality speech can be provided by using only two pulse patterns. This results in a search process requiring overall only modest computation power, and only two pulse patterns have to be stored in memory. Therefore the coding algorithm according to the invention requires overall only modest computation power and little memory.

A more detailed description of the PPELP coding method is presented with the aid of FIG. 4, which illustrates the actual implementation, and shows in a PPELP coder in detail the optimization of the pulse pattern excitation. Here it must be noted that the weighting filters according to equation (2) i.e. filters 30 and 25 in FIG. 2, have been moved away from the outputs of the subtracting means (38 and 40 in FIG. 2) so that the corresponding functions now are located before the subtracting means in the filters 60, 61 and 67.

The STP parameters are computed in the LPC analyzer 75.

In this combination the LTP parameter M is limited to values which are greater than the length of the pulse pattern excitation vector. In this case the long term prediction is based on the previous pulse pattern excitation vectors. The result of this is that now the long term prediction branch does not have to be included in the pulse pattern excitation search process. This approach substantially simplifies the coding system.

The effect of previous speech blocks i.e. the output no(n) from filter 61 of the zero input branch is subtracted from the weighted speech signal $s_w(n)$, that is the output from filter 60 to which is input the digital speech signal s(n) by the subtracting means 62. The influence of the long term prediction branch is subtracted in the subtracting means 63 before pulse pattern optimization to produce the output signal $e_{ltp}(n)$.

In order to optimize the pulse pattern excitation parameters uj, dj, oj, the responses of the pulse patterns contained in the codebook are formed using synthesizer filter, and the actual evaluation of the quality of the pulse pattern excitation is performed by correlators 65 and 68. The optimum parameters uj, dj, oj are supplied by a pulse pattern search controller 66 and used to generate the optimum excitation by pulse pattern selection block 69, the delay generator 73 and the orientation block 74 respectively. The synthesizer filter status variables are updated by applying the generated optimal excitation vector vi, opt scaled by the multiplying block 70 using scaling factor $g_{c,opt}$ generated by the pulse pattern controller, to the synthesizer filters 71 and 72. The optimization of the pulse pattern excitation parameters is explained below.

The pulse pattern codebook search process should find the pulse pattern excitation parameters that minimize the expression:

$$e_{c,i}(n) = \sum_{n=0}^{L-1} (e_{1tp}(n) - g_c\, ss_{c,i}(n))^2 \tag{5}$$

where $e_{ltp}(n)$ is the output signal from the subtracting means as discussed above, i.e. the weighted original speech signal after subtracting the zero input response no(n) and the influence of the long term prediction branch from the weighted speech signal $s_w(n)$; $ss_{c,i}(n)$ is a speech signal vector, which is synthesized in synthesizer filter. This leads to searching the maximum of:

$$R_i^2/A_i \tag{6}$$

where $$R_i = \sum_{n=0}^{L-1} e_{1tp}(n)\, ss_{c,i}(n) \tag{7}$$

and $$A_i = \sum_{n=0}^{L-1} (ss_{c,i}(n))^2 \tag{8}$$

The vector that minimizes the expression (5) is selected for optimum excitation vector $V_{i,opt}(n)$, and the notation i,opt is used as its consecutive number.

In conjunction with the optimum pulse pattern search, the scaling factor $g_c$ is also optimized to get the optimum scaling factor $g_{c,opt}$ which is used to generate the optimum scaled excitation $w_{i,opt}(n)$ to be supplied to the synthesizer filters in the decoder and to the long-term filter of the optimum branch in the encoder i.e.

$$w_{i,opt}(n) = g_{c,opt} v_{i,opt}(n) \tag{9}$$

The optimum scaling factor $g_{c,opt}$ is given by $R_{i,opt}/A_{,iopt}$, where $R_{i,opt}$ and $A_{,iopt}$ are the optimal cross-correlation and auto-correlation terms.

For a given excitation vector $v_i(n)$, the weighted synthesizer filter response $h_i(n)$ for each pulse pattern $p_i(n)$ is given by:

$$ss_{c,1}(n) = \sum_{j=1}^{K} o_j h_{uj}(n - d_j) \tag{10}$$

when $0 \leqq n \leqq L-1$, and where $h_{uj}(n)$ is the response of the weighted synthesizer filter to the pulse pattern $pu_j(n)$.

The codebook search can be performed efficiently using pulse pattern correlation vectors. The cross correlation term $R_i$ for each excitation vector $v_i(n)$ can be calculated using the pulse pattern correlation vector $r_k(n)$, where $$r_k(n) = \sum_{i=n}^{L-1} h_k(i-n)\, e_{1tp}(i) \tag{11}$$

when $0 \leqq n \leqq L-1$.

The pulse pattern correlation vector $r_k(n)$ is calculated for each pulse pattern ($k=1,2,\ldots,P$). The cross correlation term $R_i$ generated for the respective excitation vector $v_i(n)$ with regard to the signal vector to be modelled (which is formed as a combination of K pulse patterns, and defined through the pulse pattern positions $u_j$ in the pulse pattern codebook, the pulse pattern delays i.e. positions with respect to the start of the excitation vector, $d_j$, and the orientations $o_j$) can be calculated simply as:

$$R_i = \sum_{j=1}^{K} o_k\, r_{uj}(d_j) \tag{12}$$

Correspondingly the autocorrelation term $A_i$ for the synthesized speech signal can be calculated by:

$$A_i = \sum_{k=1}^{K} o_k \sum_{j=1}^{K} o_l\, rr_{uk,uj}(d_k,d_j) \tag{13}$$

where:

$$rr_{k1,k2}(n_1, n_2) = \sum_{i=\max(n_1,n_2)}^{L-1} h_{k1}(i-n_1)\, h_{k2}(i-n_2) \tag{14}$$

When the testing of the pulse pattern excitation is arranged in a sensible way regarding the calculation of the cross correlation term $rr_{k1k2}(n_1, n_2)$, the previously calculated pulse pattern cross correlation terms can be utilized in the calculations and keep the computation load and memory consumption at a low level. The pulse pattern technique is then utilized to begin optimization of the pulse pattern excitation by positioning the pulse patterns starting from the end of the excitation frame, and by counting in sequence the correlation for such pulse patterns where a pulse pattern has been moved by one sample towards the starting point of the excitation frame without then changing mutual distances between the pulse patterns. Then the pulse pattern cross correlation can be calculated for the moved pulse pattern combination by summing a new multiplied term to the previous value.

It can be seen from the above description that the pulse pattern method in these embodiment examples comprises three steps:

In the first step all pulse patterns are filtered through synthesizer filters, resulting in P pulse pattern responses $h_k(n)$, where $k=1,2,\ldots,P$.

In the second step, for L pulse pattern delays, the correlation for each pulse pattern response $h_k(n)$ with the signal $e_{ltp}$, whereby the output from the LTP branch has been subtracted from the weighted speech signal $s_w(n)$, is calculated, the procedure resulting in the correlation vector $r_k(n)$. The length of the vector is L samples, and it is calculated for P pulse patterns.

In the third step the effect of each pulse pattern excitation is evaluated by calculating the auto correlation term $A_i$ and the cross correlation term $R_i$ and, based on these, selecting the optimum excitation. In conjunction with the testing of the excitation vectors the cross correlation term $rr_{k1k2}(n_1, n_2)$ is recursively calculated for each pulse pattern combination.

According to the invention it is possible to further reduce the computation load of the pulse pattern parameter optimization presented above, by performing optimization of the pulse pattern positions in two steps. In the first step the pulse pattern delays i.e. the positions in the pulse pattern excitation, related to the starting point of the excitation blocks, are searched using for each pulse pattern $p_j(n)$ delay values, whose difference (grid spacing) is $D_j$ samples or a multiple of $D_j$. In the first step the following combinations are evaluated:

$$v_i(n) = \sum_{j=1}^{K} o_j\, p_{uj}(n - rD_j) \tag{15}$$

where $r=0,1,\ldots,[(L-1)/D_j]$, and where the function [] in this context means for truncating to integer values.

The search described above, for each pulse pattern j to be included in the excitation, results in optimal delay values $dd_j$ ($1 \leqq j \leqq K$) of a grid with a spacing $D_j$.

The second step comprises testing of the delay values $dd_j-(D_j-1)$, $dd_j-(D_j-2)$, ..., $dd_j-2$, $dd_j-1$, $dd_j+1$, $dd_j+2$, $dd_j+(D_j-2)$, $dd_j+(D_j-1)$ located in the vicinity of the optimal delay values found in step 1. In this second step a new optimizing cycle is performed according to step 1 for all pulse pattern excitation parameters, limited however to the above mentioned delay values in the vicinity of said $dd_j$. As a result the final pulse pattern parameters $u_j$, $d_j$ and $o_j$ are obtained.

The two-step search for the positions of the pulse patterns in the excitation vector makes it possible to reduce the computation load of the PPELP coder further from the above presented values, without substantially degrading the subjective quality provided by the method, if the grid spacing $D_j$ is kept reasonably modest. For example, for $K=2$ the use of grid spacings of $D_1=1$ and $D_2=3$ still produces a good coding result.

Figure 5A:
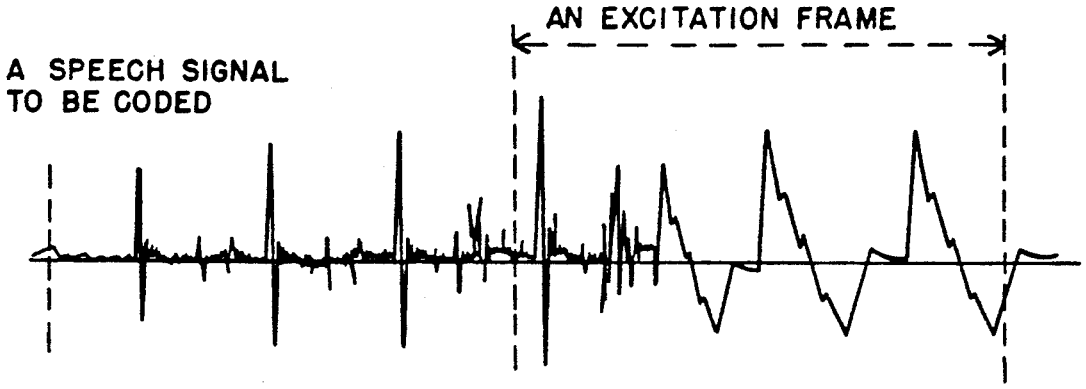
FIG. 5*a* illustrates a speech signal to be coded and excitation frames.
Figure 5B:
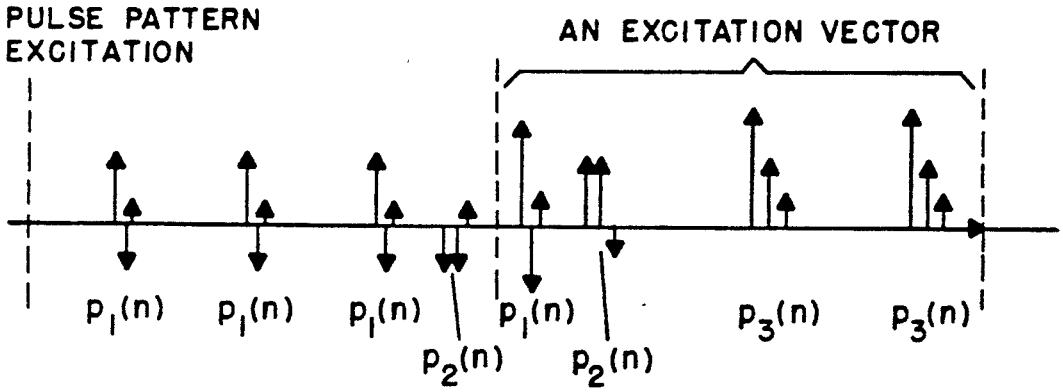
FIG. 5*b* illustrates pulse pattern excitation and excitation vectors.
Figure 5C:
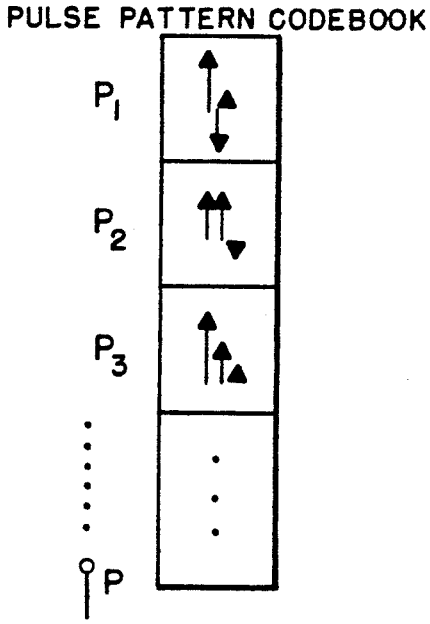
FIG. 5*c* graphically depicts several entries within a pulse pattern codebook.

Reference is made to FIGS. 5*a*–5*c* which graphically depict the operations which have been described in detail above, and which are provided as an aid to understanding the operation of the method and circuitry of this invention. FIG. 5*a* depicts an analog speech signal which is to be coded. The analog speech signal is digitized into frames, and the best excitation vector for the frame is to be determined. For example, the speech frame is divided into four subframes, and a best excitation vector is determined for each subframe.

FIG. 5*c* represents a codebook containing pulse patterns $P_1, P_2, P_3, \ldots P_p$. The method forms sets of pulse patterns, each set including, in this example, four patterns. All variations of sets containing four pulse patterns are formed. It should be noted that the patterns in a set can be the same, e.g. $P_1, P_1, P_1, P_1$. In each particular set the patterns are arranged at the grid points of an excitation vector. In this regard, the vector is first divided into an equidistant grid. The filter response is then compared with the actual speech vector and an error signal is formed and stored in the codebook search controller. Next, the positions of the pulse patterns in the vicinity of their grid points are shifted and their orientations are varied, a plurality of excitation vectors are formed, and the resultant error signals are determined and stored in the codebook search controller. These excitation vectors may be referred to as "vector candidates".

After the particular set has been examined, a new set of pulse patterns is selected. A plurality of excitation vector candidates are created and their error signals are stored as described above. After all sets have been so examined, a vector candidate yielding the smallest error signal is selected as the final excitation vector.

In FIG. 5*b* there are shown two excitation vectors beneath the two speech signal frames of FIG. 5*a*. The first excitation vector includes the pulse patterns $P_1$, $P_1$, $P_1$, $P_2$, and the second excitation vector includes the pulse patterns $P_1$, $P_2$, $P_3$, $P_3$. It should be noted that the orientation of the pulse pattern $P_2$ in the first excitation vector is reversed in comparison to the corresponding pulse pattern that is stored in the codebook of FIG. 5*c*. Now that the parameters (i.e. the pulse pattern set, the positions of the pulse patterns along the vector, and their orientations) are fully determined for the excitation vector, the decoder is subsequently able to reconstruct the original speech vector in accordance with the parameters.

To a person skilled in the art it should be obvious through the above description that it is possible to employ the inventive idea in different ways by modifying the presented embodiment examples, without departing from the enclosed claims and their scope.

We claim:

1. A method for generating an excitation vector in a code excited linear predictive coder for processing digital speech signals partitioned into frames, in which:

(a) a short term synthesizer filter and a long term synthesizer filter are serially coupled together such that an output of said long term synthesizer filter feeds an input of said short term synthesizer filter, said long term synthesizer filter and said short term synthesizer filter are excited by an excitation vector to generate a reconstructed speech frame; and (b) an error signal is formed for representing a difference between an input speech frame and the reconstructed speech frame;

the method comprising the steps of:

(i) deriving from a codebook all variations of a plurality of sets, each set comprising a predetermined number K of pulse patterns, the codebook having a number P of pulse patterns stored therein, wherein $P>K$;

(ii) with respect to individual ones of the plurality of sets, creating a plurality of excitation vector candidates by (a) arranging pulse patterns to form a candidate excitation vector, and (b) by shifting a position and changing an orientation of each pulse pattern along the candidate excitation vector;

(iii) determining which of the plurality of excitation vector candidates gives a minimum value for the error signal, and selecting the determined candidate excitation vector as an excitation vector; and (iv) outputting the set, the position, and the orientation of pulse patterns along the selected excitation vector as output parameters of the coder.

2. A method according to claim 1, wherein, (a) with respect to individual ones of the plurality of sets, the excitation vector is divided into an equidistant gird, the pulse patterns are positioned at grid points and positions of those pulse patterns are searched, in which the error signal is minimum, whereafter an optimum set of the pulse patterns and corresponding first positions on the grid are obtained; and (b) excitation vector candidates are created by shifting the position and changing the orientation of the pulse patterns in the vicinity of the corresponding first positions on the grid.

3. A method according to claim 1, wherein, (a) with respect to individual ones of the plurality of sets, the excitation vector is divided into an equidistant grid wherein the distance between adjacent grid points is larger than a sampling interval, the pulse patterns are positioned at grid points and positions of those pulse patterns are searched, in which the error signal is minimum, whereafter an optimum set of the pulse patterns and corresponding first positions on the grid are obtained; and (b) excitation vector candidates are created by shifting the position and changing the orientation of the pulse patterns in the vicinity of the corresponding first positions on the grid, wherein a shift of the position of each individual pulse pattern is one sampling interval at a time.

4. A method for generating an excitation vector in a code excited linear predictive coder for processing digital speech signals partitioned into frames, in which:

(a) a short term synthesizer filter and a long term synthesizer filter are serially coupled together such that an output of said long term synthesizer filter feeds an input of said short term synthesizer filter, said long term synthesizer filter and said short term synthesizer filter are excited by an excitation vector to generate a reconstructed speech frame; and (b) an error signal is formed for representing a difference between an input speech frame and the reconstructed speech frame;

the method comprising the steps of:

(i) applying all pulse patterns from a codebook to the filters and storing responses to the pulse patterns that are output from the filters, the codebook having a number P of pulse patterns stored therein;

(ii) forming all variations of a plurality of sets, each set comprising a predetermined number K of pulse pattern responses wherein $P>K$;

(ii) with respect to individual ones of the plurality of sets, creating a plurality of reconstructed speech vector candidates by arranging the pulse pattern responses to form a first vector and by shifting the position and changing orientation of each pulse pattern response along the first vector, (iii) determining which of the reconstructed speech vector candidates gives a minimum value for the error signal and selecting a first vector, whose filter response is the reconstructed speech vector candidate, as the excitation vector; and (iv) outputting the set, the position, and the orientation of pulse patterns along the selected excitation vector as output parameters of the coder.

5. A method according to claim 4, wherein, (a) with respect to each of the plurality of sets, the vector is divided into an equidistant grid, the pulse pattern responses are positioned at grid points and the positions of those pulse pattern responses are searched, in which the error signal is minimum, whereafter an optimum set of pulse pattern responses and corresponding first positions on the grid are obtained; and (b) excitation vector candidates are created by shifting the position and changing the orientation of the pulse pattern responses in the vicinity of corresponding first positions on the grid.

6. A method according to claim 4, wherein, (a) with respect to each of the plurality of sets, the first vector is divided into an equidistant grid, the distance between adjacent grid points being larger than a sampling period, the pulse pattern responses are positioned at grid points and the positions of those pulse pattern responses are searched, in which the error signal is minimum, whereafter an optimum set of the pulse pattern responses and corresponding first positions on the grid are obtained; and (b) excitation vector candidates are created by shifting the position and changing the orientation of the pulse pattern responses in the vicinity of the corresponding positions on the grid, wherein a shift of the position of each individual pulse pattern is one sampling interval at a time.

7. A speech coder for processing digital speech signals partitioned into frames as a speech vector, comprising:

linear prediction coefficient analyzing means for generating a set of prediction parameters responsive to an input speech frame;

comparison means responsive to the input speech frame and to a synthesized speech frame for forming a perceptually weighted error signal;

controller means for controlling an excitation codebook search in a pulse pattern codebook, for storing said perceptually weighted error signals, and for determining a minimum value error signal thereof;

long-term and short-term synthesis filter means that are serially coupled together and responsive to a scaled excitation vector for generating the synthesized speech frame, characteristics of said short-term synthesis filter being said prediction parameters;

said pulse pattern generator further including:

means for forming all variations of a plurality of sets, each set comprising a predetermined number K of pulse patterns, said pulse patterns being derived from a pulse pattern codebook having a number P of pulse patterns stored therein, where $P>K$;

pulse pattern position means for positioning the pulse patterns of each set of the plurality of sets into predetermined points of a vector and for shifting the position of each pattern along said vector; and orientation means for changing orientation of pulse patterns of said vector;

wherein a plurality of excitation vector candidates are created by shifting and orienting the pulse patterns of each set along the vector, and wherein the excitation vector candidate having a minimum perceptually weighted error signal is selected as the excitation vector.

* * * * *

UNITED STATES PATENT AND TRADEMARK OFFICE

CERTIFICATE OF CORRECTION

PATENT NO. : 5,327,519

DATED : July 5, 1994

INVENTOR(S) : Haggvist et al.

It is certified that error appears in the above-indentified patent and that said Letters Patent is hereby corrected as shown below:

On the title page, item [75]

Inventors: "Jari Haggvist", the first named inventor, should read --Jari Hagqvist--.

Signed and Sealed this

Fifteenth Day of November, 1994

Bruce Lehman

*Attest:*

BRUCE LEHMAN

*Attesting Officer*

*Commissioner of Patents and Trademarks*